US007220017B2

(12) United States Patent
Lee et al.

(10) Patent No.: US 7,220,017 B2
(45) Date of Patent: May 22, 2007

(54) METHOD AND SYSTEM OF CONTROLLING BICOLOR LUMINARY SYSTEM

(75) Inventors: Joon Chok Lee, Poh Kwong Park (MY); Kevin Len-Li Lim, Taman Lake View (MY); Jaffar Rizal, Batu (MY); Kee Yean Ng, Halaman Kikik (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 247 days.

(21) Appl. No.: 11/086,138

(22) Filed: Mar. 22, 2005

(65) Prior Publication Data

US 2006/0215407 A1 Sep. 28, 2006

(51) Int. Cl.
*F21Y 101/02* (2006.01)

(52) U.S. Cl. ..... 362/231

(58) Field of Classification Search ..... 362/612, 362/555, 230, 231

See application file for complete search history.

(56) References Cited

U.S. PATENT DOCUMENTS 5,851,063 A * 12/1998 Doughty et al. ..... 362/231
2003/0067773 A1* 4/2003 Marshall et al. ..... 362/231

* cited by examiner

*Primary Examiner*—Laura Tso

(57) ABSTRACT

A light source that generates light that is perceived to have a predetermined color is disclosed. The light source includes first and second red LEDs and a non-red light emitter. The first and second red LEDs emit light in the red portion of the spectrum but at different wavelengths. The non-red light emitter emits light at a wavelength in a non-red portion of the spectrum. A controller varies the intensity of the first and second red LEDs to provide a combined light signal that is perceived as having the predetermined color. In one embodiment, the non-red light emitter includes a fluorescent light, and the controller adjusts the intensities of the red LEDs to provide a source that is perceived as an incandescent source of a predetermined color temperature.

11 Claims, 3 Drawing Sheets

METHOD AND SYSTEM OF CONTROLLING BICOLOR LUMINARY SYSTEM

BACKGROUND OF THE INVENTION

The present invention can be more easily understood with respect to a light source for use in backlit LCD displays. Such displays are widely used in image display applications including computer displays and stand alone displays of the type used in advertising and the like. These displays utilize a pixilated image plane in which each pixel includes a color filter and an LCD shutter. The pixels are illuminated with white light from a source behind the image plane. A viewer in front of the image plane sees an image that is generated by opening the individual pixel shutters for a time proportional to the intensity of light that is to be perceived as originating from that pixel. A color image is generated by utilizing three closely spaced pixels having different color filters. The image is repeatedly generated to give the impression of a still or moving picture with the desired color intensity values at each pixel.

Ideally, the light source used for the display is a white light source having a color temperature that can be set for various applications. At present, most displays of this type utilize a fluorescent light source. Fluorescent light sources have significantly longer life-times and provide more light output for a given electrical power into the light source than incandescent sources. Unfortunately, the color temperature of such sources is not easily varied, as the output spectrum depends mainly on the phosphors used in the device.

In principle, white light sources based on light-emitting diodes (LEDs) can provide the desired color temperature variation and life-times. A light source having three different color LEDs can provide a wide range of colors, and hence, duplicate a wide range of color temperatures. Unfortunately, with the exception of red LEDs, currently available LEDs have a number of drawbacks that inhibit their use in such backlit displays.

First, the light available from a single LED is often too low to provide the necessary brightness. As a result, a large number of LEDs of each color are needed. The cost of these LEDs is too high to make such sources competitive with fluorescent displays. In addition, the output of each LED changes with age, drive current, and temperature. As a result, some form of feedback system is typically used to continuously adjust the drive current or duty factor of each LED to compensate for drift in the output from these and other factors. Furthermore, LEDs that emit colors other than red have lower power conversion efficiencies than the red LEDs. These LEDs also tend to be more expensive to manufacture than red LEDs.

SUMMARY OF THE INVENTION

The present invention includes a light source that generates light that is perceived to have a predetermined color. The light source includes first and second red LEDs and a non-red light emitter. The first and second red LEDs emit light in the red portion of the spectrum having first and second wavelengths, respectively, the first wavelength being different from the second wavelength. The non-red light emitter emits light at a wavelength in a non-red portion of the spectrum. A controller varies the intensity of the first and second red LEDs to provide a combined light signal that is perceived as having the predetermined color. In one embodiment, the non-red light emitter includes a fluorescent light. In another embodiment, the non-red light emitter includes an LED that emits light in the blue and yellow spectral regions. In one embodiment, the controller varies the intensity of the first and second red LEDs such that the predetermined color is perceived to be light from an incandescent light source having a predetermined color temperature. In one embodiment, the light source includes a photodetector that generates signals indicative of the light emitted from the light source in three different spectral regions, and the controller varies the intensities of light from the first and second red LEDs to maintain the signals at predetermined values.

DETAILED DESCRIPTION OF THE PREFERRED EMBODIMENTS OF THE INVENTION

The present invention is based on the observation that a compound light source constructed from a white light having a fixed color temperature and a plurality of red LEDs having different emission wavelengths can provide the advantages of a variable color temperature while preserving the advantages of a fluorescent light source. Since the cost of red LEDs is relatively low, the resultant compound light source has cost advantages over light sources based on other configurations, such as multiple LEDs of three different colors.

Figure 1:
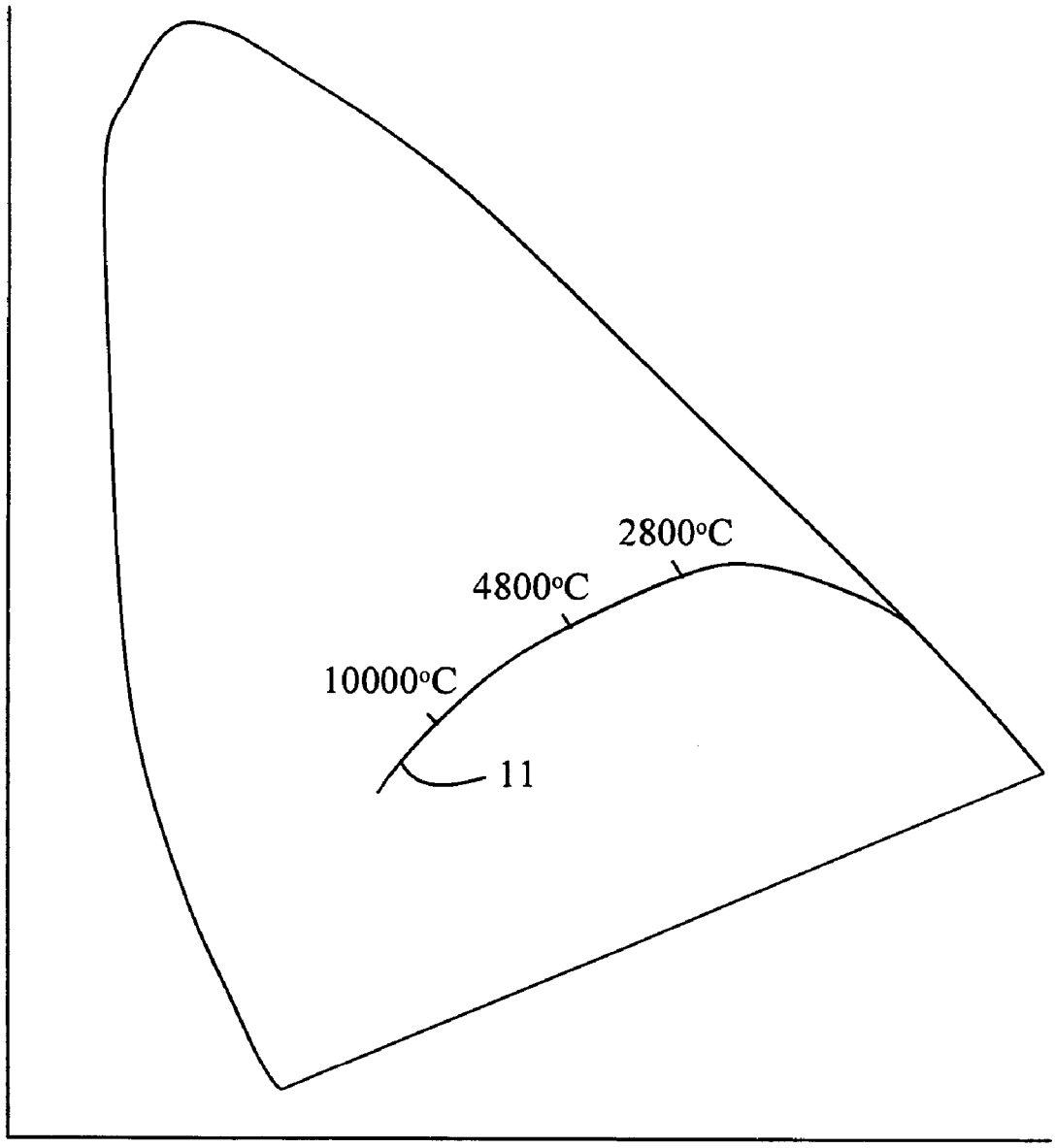
FIG. 1 illustrates the curve in the CIE 1931 color space corresponding to a white incandescent light source at various color temperatures.

Refer now to FIG. 1, which illustrates the curve in CIE 1931 color space corresponding to a white incandescent light source at various color temperatures. A light source that is to be perceived as an incandescent source with a particular color temperature must lie at the appropriate point on curve 11.

Given a white light source that lies on this curve, i.e., is perceived as matching an incandescent source of some particular color temperature, an approximation to a light source having other color temperatures can be constructed by adding light from a red light source. By varying the relative intensities of the two sources, light sources with colors along the line connecting the two light sources in the color space can be obtained. However, the resultant composite light source is, at best, an approximation to the desired incandescent source, since the incandescent source curve is not a straight line.

Figure 2:
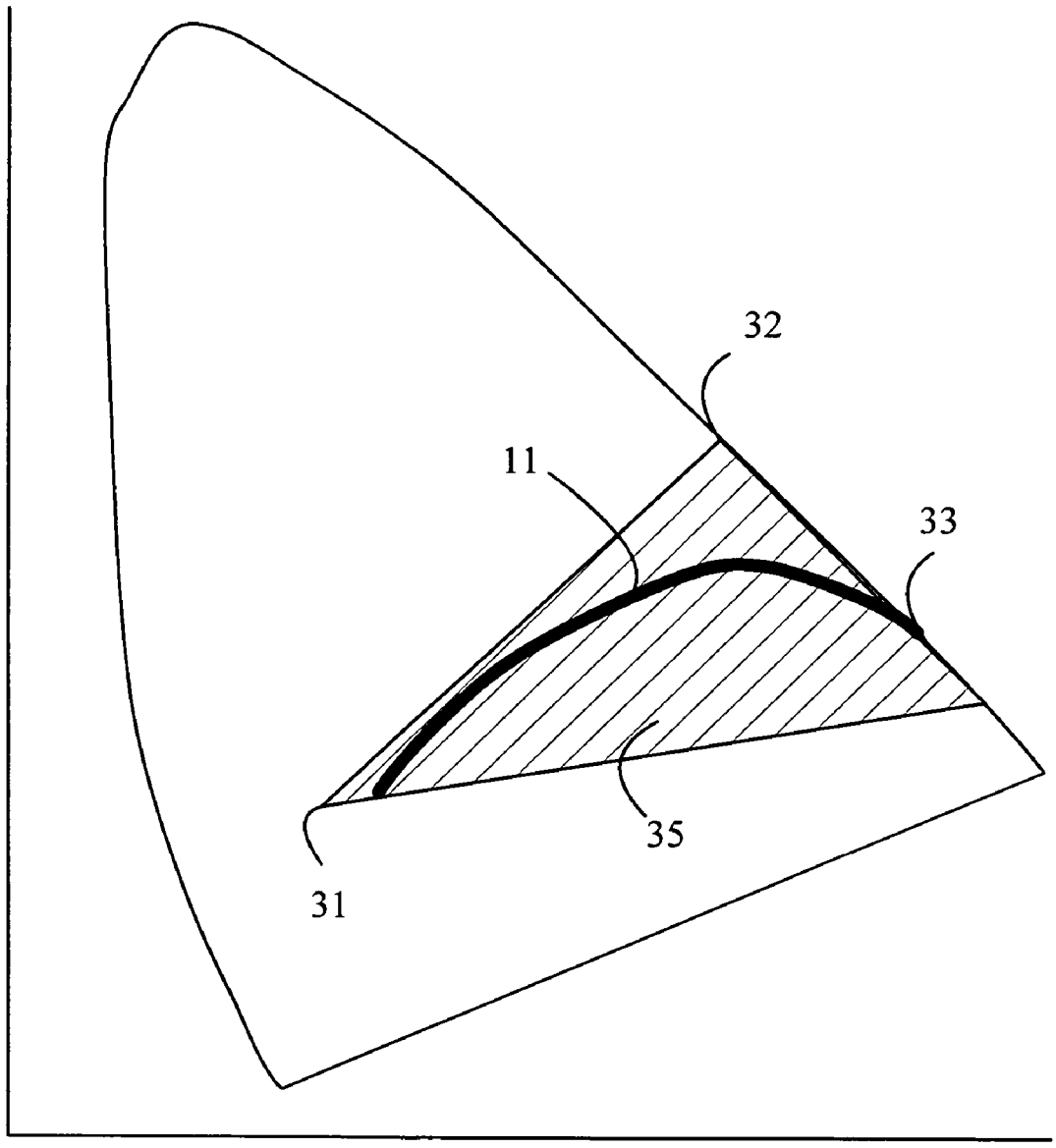
FIG. 2 illustrates the region of the 1931 CIE chromaticity diagram that can be reached by such a light source having two red LEDs and a fixed intensity white light source.

The present invention overcomes this problem by using two red light sources having different wavelengths. Refer now to FIG. 2, which illustrates the region of the 1931 CIE chromaticity diagram that can be reached by such a light source. The light source contains three light sources, a white light source shown at 31, and two red light sources shown at 32 and 33. By varying the relative intensity of the light sources, any point within region 35 can be reached. In one preferred embodiment, region 35 is selected so as to contain the curve 11 for an incandescent white light source as discussed above.

As noted above, LED characteristics vary with temperature, drive current, and age. In addition, fluorescent light sources also have characteristics that vary with temperature.

Figure 3:
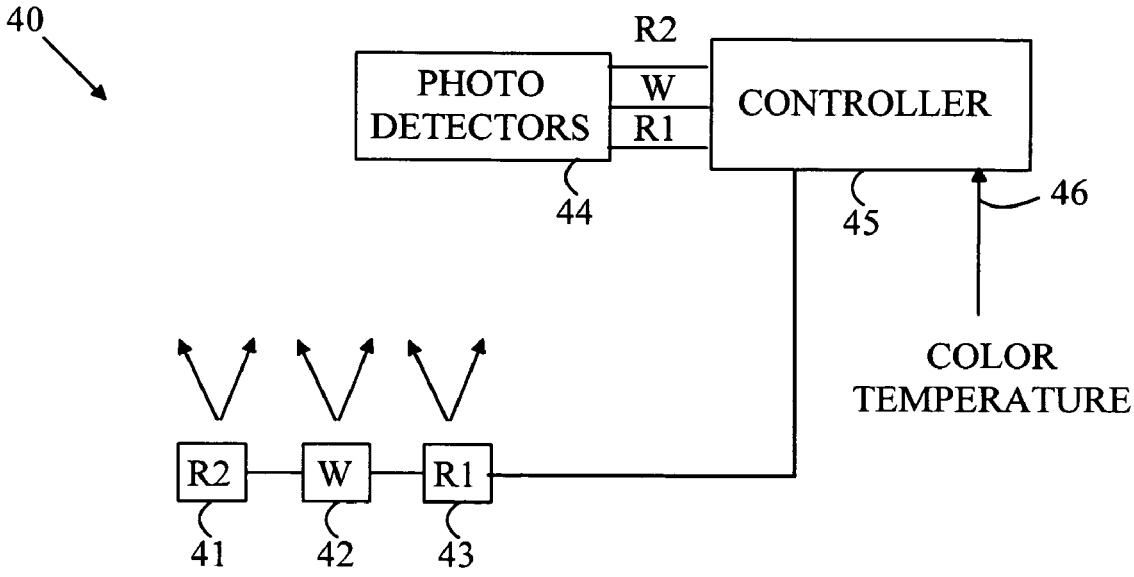
FIG. 3 illustrates one embodiment of a light source according to the present invention.

Accordingly, a light source according to the present invention includes a feedback system that varies the intensity of the LEDs to maintain the output spectrum at the desired color. Refer now to FIG. 3, which illustrates one embodiment of a light source according to the present invention. Light source 40 includes a fixed intensity white light source 42 and two red LED sources 41 and 43 having different wavelengths and whose output intensity can be varied. The combined output of these light sources is sampled by an array of photodetectors 44. Each photodetector includes a bandpass filter such that the signal from the photodetector represents the intensity of light in a predetermined range of wavelengths. A controller 45 reads the output from the photodetectors and adjusts the output of LEDs 41 and 43 to maintain each photodetector output at a predetermined value. Since such feedback systems are conventional in the art, they will not be discussed in detail here.

The photodetectors, in general, must be calibrated in terms of the 1931 CIE color standard to provide a source that is perceived as an incandescent source of the desired color temperature. In one preferred embodiment, controller 45 contains a calibration table that provides a mapping between the output signals from the photodetectors and the intensity of the color components corresponding to the standard curves discussed above. The photodetectors can be calibrated using a calibrated light source. For example, an incandescent bulb operating at a known color temperature can be used to irradiate the photodetectors. By measuring the output of the photodetectors at several color temperatures, the required mapping can be generated.

The intensity of light from each LED can be varied in a number of ways. For example, the drive current through the LED can be varied by increasing the voltage across the LED. Alternatively, the LED can be driven by an AC signal that turns the LED on and off. In such systems, the perceived intensity of light can be altered by varying the ratio of the on to off time periods while keeping the drive current constant.

While the embodiment shown in FIG. 3 shows only a single LED of each color, it is to be understood that each LED can be replaced by a bank of LEDs that emit the same color. In such systems, the intensity of light can also be controlled by varying the number of LEDs that are emitting light at any given time. Arrangements having a plurality of LEDs of each color also provide a convenient means for increasing the intensity of the LED sources relative to the fluorescent source, since fluorescent sources, in general, still provide significantly more light that that available from a single LED, and hence, the ratio of light intensities that can be obtained with a single LED is limited.

In one embodiment, controller 45 includes an input port 46 that receives a signal that specifies a color temperature. Controller 45 adjusts the relative intensities of the red LEDs to provide a light source that is perceived as being an incandescent light source operating at that color temperature. Such embodiments are particularly useful in home lighting systems. The adoption of fluorescent lighting systems has been slow in residential applications in spite of the improved lifetime and power efficiency provided by such light sources. One reason for the resistance to such sources has been the "harsh" light generated by fluorescent lights as compared to incandescent lights. The present invention provides a light source that is perceived to be an incandescent light source. In addition, the present invention allows the user to set the level of "warmth" of the source. Hence, the user can set the source to a relatively low color temperature to provide a warm setting for a social gathering. When the user requires a source having a higher color temperature for reading, the user can alter the color temperature to a higher value.

The above-described embodiments of the present invention utilize a fluorescent light source as a fixed intensity source whose spectrum is varied by mixing the light with light from two red LED sources. However, embodiments that utilize other light sources in place of the fixed light source can also be constructed. For example, light sources that are perceived to be white can be constructed by mixing blue and yellow light in the proper ratio. Such a source can be constructed from a single blue LED that is covered with a phosphor that converts a portion of the blue light to yellow light. In this case, the intensity of the white light source can also be varied, and hence, a wider range of color temperatures can be obtained.

Such sources, however, suffer from manufacturing variability and aging effects. By incorporating two relatively inexpensive red LED sources as discussed above, a compound light source that is perceived to be an incandescent source of a specified color temperature can be obtained. Furthermore, the defects discussed above can be corrected to provide a light source that is uniform in perceived color and intensity over the life of the source.

Red LEDs constructed from AlInGaP or AlGaAs can be used in the present invention to provide the red LED sources. The preferred LED sources emit at 580 nm and 650 nm. That is, point 32 shown in FIG. 2 corresponds to an LED emitting light at 580 nm and point 33 corresponds to an LED emitting light at 650 nm. Such sources in combination with a white fluorescent source can reproduce the blackbody radiation curve corresponding to temperatures between 2000° C. and 25,000° C.

The above-described embodiments of the present invention include a compound light source having some form of "white" light source in combination with two red LEDs that emit light at different wavelengths. However, compound light sources based on non-white light sources can also be constructed. The combination of light sources provides a source that can be adjusted to function within a limited region of the color space. While the range of adjustment cannot provide a source with an arbitrary color, the range can be sufficient to correct for variations in color resulting from such sources as temperature, aging, and manufacturing variability, at a relatively low cost.

Various modifications to the present invention will become apparent to those skilled in the art from the foregoing description and accompanying drawings. Accordingly, the present invention is to be limited solely by the scope of the following claims.

What is claimed is:

1. A light source that generates light that is perceived to have a predetermined color, said light source comprising:

a first red LED that emits light of a first wavelength in the red portion of the spectrum;

a second red LED that emits light in the red portion of the spectrum, said light having a second wavelength that is different from said first wavelength;

a third light emitter that emits light at a wavelength in a non-red portion of the spectrum; and a controller that varies the intensity of said first and second red LEDs to provide a combined light signal that is perceived as having said predetermined color.

2. The light source of claim 1 wherein said first and second wavelengths are between 580 nm and 640 nm.

3. The light source of claim 1 wherein said third light emitter comprises a fluorescent light.

4. The light source of claim 1 wherein said third light emitter comprises an LED that emits light in the blue and yellow spectral regions.

5. The light source of claim 1 wherein said controller varies the intensity of said first and second red LEDs such that said predetermined color is perceived to be light from an incandescent light source having a predetermined color temperature.

6. The light source of claim 1 further comprising a photodetector that generates signals indicative of the light emitted from said light source in three different spectral regions, and wherein said controller varies said intensities of light from said first and second red LEDs to maintain said signals at predetermined values.

7. A method for generating light that is perceived to have a predetermined color, said method comprising:

generating light of first, second, and third wavelengths, said first and second wavelengths being in the red portion of the optical spectrum and said third wavelength being in a different portion of the optical spectrum; and adjusting the intensity of said light of said first and second red LEDs to provide a combined light signal that is perceived as having said predetermined color.

8. The method of claim 7 wherein said first and second wavelengths are between 580 nm and 640 nm.

9. The method of claim 7 wherein light of said third wavelength is generated by a fluorescent light.

10. The method of claim 7 wherein light of said third wavelength is generated by an LED that emits light in the blue and yellow spectral regions.

11. The method of claim 7 wherein said predetermined color is perceived to be light from an incandescent light source having a predetermined color temperature.

* * * * *